US006662996B2

(12) United States Patent
Hartjes

(10) Patent No.: US 6,662,996 B2
(45) Date of Patent: Dec. 16, 2003

(54) CUP AND METHOD FOR MAKING CUP WITH INTEGRALLY FORMED U-SHAPED BOTTOM CHANNEL

(75) Inventor: Timothy P. Hartjes, Kimberly, WI (US)

(73) Assignee: Georgia-Pacific Corporation, Atlanta, GA (US)

( * ) Notice: Subject to any disclaimer, the term of this patent is extended or adjusted under 35 U.S.C. 154(b) by 0 days.

(21) Appl. No.: 10/061,613

(22) Filed: Feb. 1, 2002

(65) Prior Publication Data

US 2003/0146273 A1 Aug. 7, 2003

(51) Int. Cl.[7] ..... B65D 3/12
(52) U.S. Cl. ..... 229/400; 229/5.5
(58) Field of Search ..... 229/4.5, 5.5, 5.8, 229/400

(56) References Cited

U.S. PATENT DOCUMENTS

| | | | | |
|---|---|---|---|---|
| 2,611,154 A | | 9/1952 | Chevrier | |
| 3,137,431 A | * | 6/1964 | Crouse et al. | 229/4.5 |
| 3,157,339 A | | 11/1964 | Negoro | |
| 3,164,314 A | * | 1/1965 | Waycie | 229/400 |
| 3,322,045 A | | 5/1967 | Tanona | |
| 3,439,590 A | | 4/1969 | Rosenberg et al. | |
| 3,547,012 A | | 12/1970 | Amberg et al. | |
| 3,855,908 A | | 12/1974 | Schmidt et al. | |
| 3,949,927 A | * | 4/1976 | Smith et al. | 229/5.5 |
| 3,973,316 A | | 8/1976 | Maher | |
| 4,127,059 A | | 11/1978 | Richards | |
| 4,168,676 A | * | 9/1979 | Itoh | 229/400 |
| 4,187,768 A | | 2/1980 | Suzuki | |
| 4,211,339 A | * | 7/1980 | Itoh | 229/400 |
| 4,222,974 A | | 9/1980 | Smith | |
| 4,373,928 A | | 2/1983 | Horton | |
| 4,428,741 A | | 1/1984 | Westphal | |
| 4,430,142 A | | 2/1984 | Ochi et al. | |
| 4,435,344 A | | 3/1984 | Iioka | |
| 4,757,936 A | | 7/1988 | Homma et al. | |
| 4,836,400 A | * | 6/1989 | Chaffey et al. | 229/400 |
| 5,363,982 A | | 11/1994 | Sadlier | |
| 5,431,619 A | | 7/1995 | Bacon et al. | |
| 5,490,631 A | | 2/1996 | Iioka et al. | |
| 5,725,916 A | | 3/1998 | Ishii et al. | |
| RE35,830 E | | 6/1998 | Sadlier | |
| 5,766,709 A | | 6/1998 | Geddes et al. | |
| 5,840,139 A | | 11/1998 | Geddes et al. | |
| 5,993,705 A | | 11/1999 | Grishchenko et al. | |
| 6,030,476 A | | 2/2000 | Geddes et al. | |
| 6,129,653 A | | 10/2000 | Fredricks et al. | |
| 6,139,665 A | | 10/2000 | Schmelzer et al. | |
| 6,142,331 A | | 11/2000 | Breining et al. | |
| 6,308,883 B1 | | 10/2001 | Schmelzer et al. | |
| 6,319,590 B1 | | 11/2001 | Geddes et al. | |
| 6,328,557 B1 | | 12/2001 | Grishchenko et al. | |

FOREIGN PATENT DOCUMENTS

| | | | | |
|---|---|---|---|---|
| DE | 819036 | | 10/1951 | |
| GB | 383003 | | 10/1931 | |
| JP | 5-147639 A | * | 6/1993 | 229/4.5 |

* cited by examiner

*Primary Examiner*—Gary E. Elkins
(74) *Attorney, Agent, or Firm*—Fulbright & Jaworski, LLP

(57) ABSTRACT

The present invention provides a cup less likely to leak by forming a u-shaped channel about a periphery of a bottom blank, forming a top blank into a generally cylindrical shape, and coupling an edge of the top blank to the u-shaped channel of the bottom blank.

24 Claims, 8 Drawing Sheets

FIG. 1B
PRIOR ART
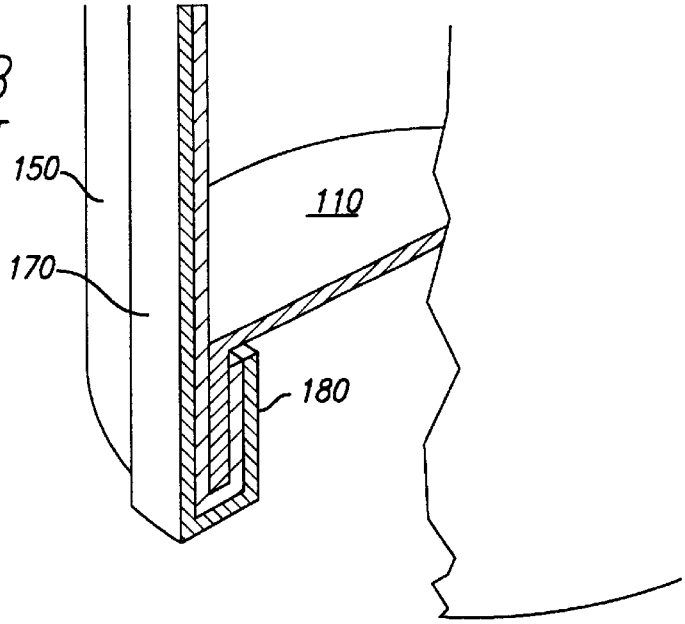
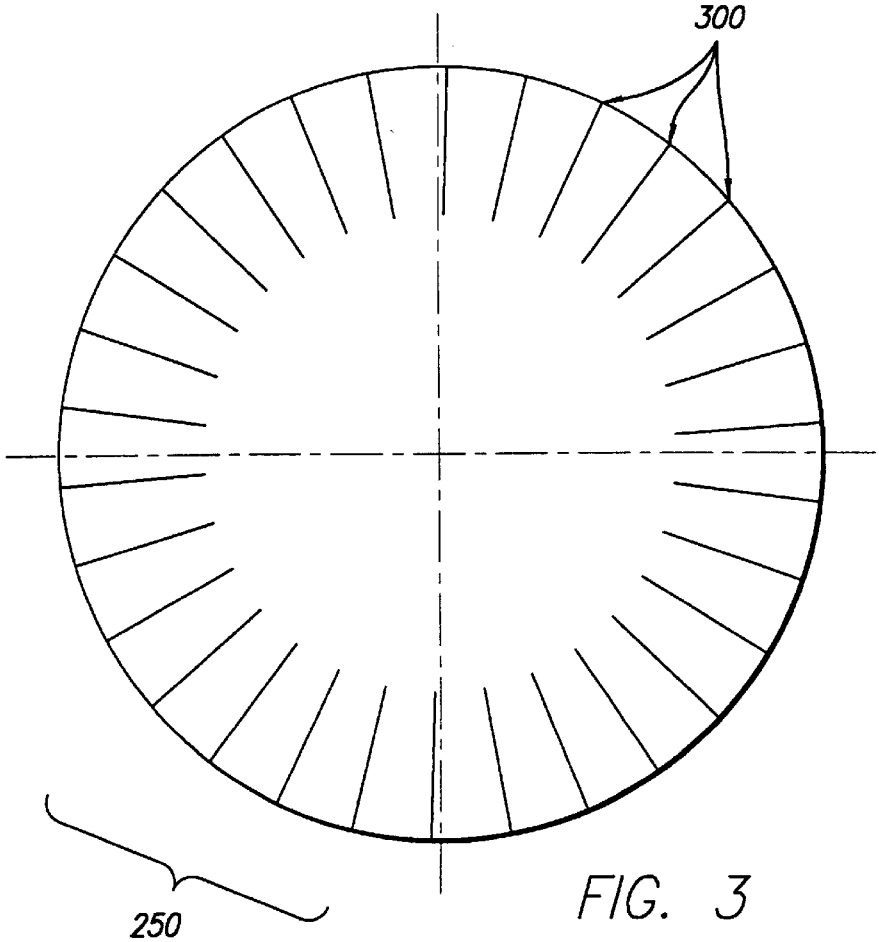
FIG. 3

CUP AND METHOD FOR MAKING CUP WITH INTEGRALLY FORMED U-SHAPED BOTTOM CHANNEL

BACKGROUND OF THE INVENTION

The present invention relates to the field of leakproof paper cups and the making thereof.

Volume production of paper cups and plastic coated paper cups has achieved considerable success in the United States of America and abroad. One deficiency inherent in the cups formed using a layer of insulating foam is that the leak rate per million cups is almost double when compared to cups formed using plain paper stock. However, insulating foam cups have proven to be very popular. An unsolved problem is how to produce a better bottom seam seal for insulating foam cups since most of the leaks occur where the side seam adjoining a lower cylindrical portion of the cup attaches to the bottom blank.

FIG. 1A shows a cross section of a prior art cylindrical cup 100. The peripheral wall 150 of cup 100 has its lower edge 160 curved inwardly and upwardly forming a channel.

The circular bottom blank 110 is typically a single layer of board and has a downwardly extending skirt 120 formed about its periphery.

FIG. 1A also shows where the prior art applies heat to seal the bottom blank 110 to the peripheral wall 150. Heat is applied at 130 to the interior of the shallow hollow formed below the ascending sidewall 140 and the bottom blank 110.

FIG. 1B shows a more detailed cutaway of an X-point 180 where five layers of board come together. The X-point 180 is especially prone to leaks.

Typically, a single layer of board is shaped to form a peripheral wall 150 of a cup 100. The two edges of the peripheral wall board meet and overlap to form a side seam 170. The side seam 170 is created by overlapping the two edges of the board and sealing them together. Because the board is overlapped to form the side seam 170, the side seam 170 is two layers thick. Because the peripheral wall 150 has its lower edge 160 curved inwardly and upwardly to form the channel, a double layer of the peripheral wall 150 is thus also curved inwardly and upwardly at the seam 170.

At all points where the peripheral wall 150 meets the bottom blank 110, except at the X-point 180, there are three layers of board. To seal the peripheral wall 150 to the bottom blank 110, the heat must penetrate two layers of board. The two layers of board are the peripheral wall's 150 single layer and the bottom blank's 110 single layer.

But, at the X-point 180 is where side seam 170 meets the periphery of bottom blank 110, the side seam 170 is four layers thick, two layers on the outside and two layers on the inside where the side seam 170 is folded upward. When the bottom blank 110 is then coupled to the top blank, the X-point 180 becomes five layers thick. To seal at the X-point 180, the heat must penetrate three layers of board. The three layers of board are the side seam's 170 two outer layers and the bottom blank's 110 single layer.

BRIEF SUMMARY OF THE INVENTION

The present invention provides a cup less likely to leak by forming a u-shaped channel about a periphery of a bottom blank, forming a top blank into a generally cylindrical shape, and coupling an edge of the top blank to the u-shaped channel of the bottom blank.

BRIEF DESCRIPTION OF THE DRAWINGS

The above and other features and advantages of the invention will be more apparent from the following detailed description wherein:

FIG. 1B (Prior Art) is a cross sectional, elevational view of a prior art cup showing the X-point being five layers thick;

FIG. 3 is a plan view of a bottom blank of one embodiment of this invention with scores making it easier to form part of the bottom blank into a u-shaped channel;

DETAILED DESCRIPTION OF THE INVENTION

The present invention comprises an improved cup where the bottom periphery of a generally cylindrical top blank without a lower channel fits into a bottom blank having a preformed, generally u-shaped channel about its periphery.

Figure 2A:
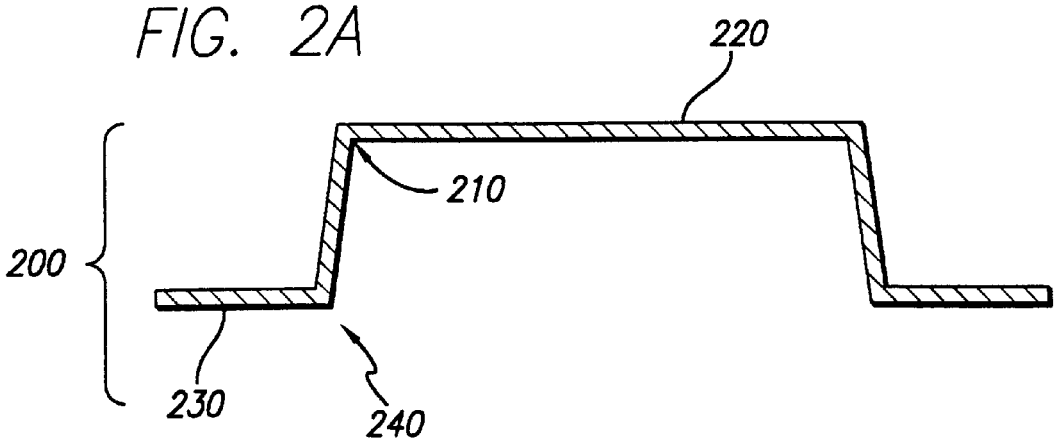
FIG. 2A is a cross sectional, elevational view of a bottom blank of one embodiment of this invention having a first bend forming a circular flange.
Figure 2B:
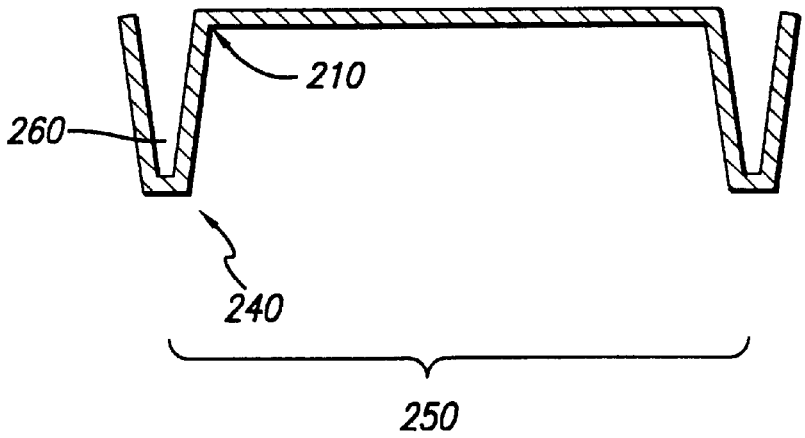
FIG. 2B is a cutaway of a bottom blank of one embodiment of this invention having a fully formed u-shaped channel.

FIG. 2A shows a bottom blank 200 having an upper surface 220. The bottom blank 200 has a first bend 210 and a second bend 240 to create an edge 230 about the periphery of the bottom blank 200. FIG. 2B shows a completely formed bottom blank 250 with the first bend 210 and the second bend 240. The second bend 240 is completed to form a u-shaped channel 260 about the periphery of the bottom blank 250.

FIG. 3 is the bottom blank 250 in a plan view, with scoring 300 to assist with the forming of the bends 210, 240 shown in FIGS. 2A and 2B.

Figure 4:
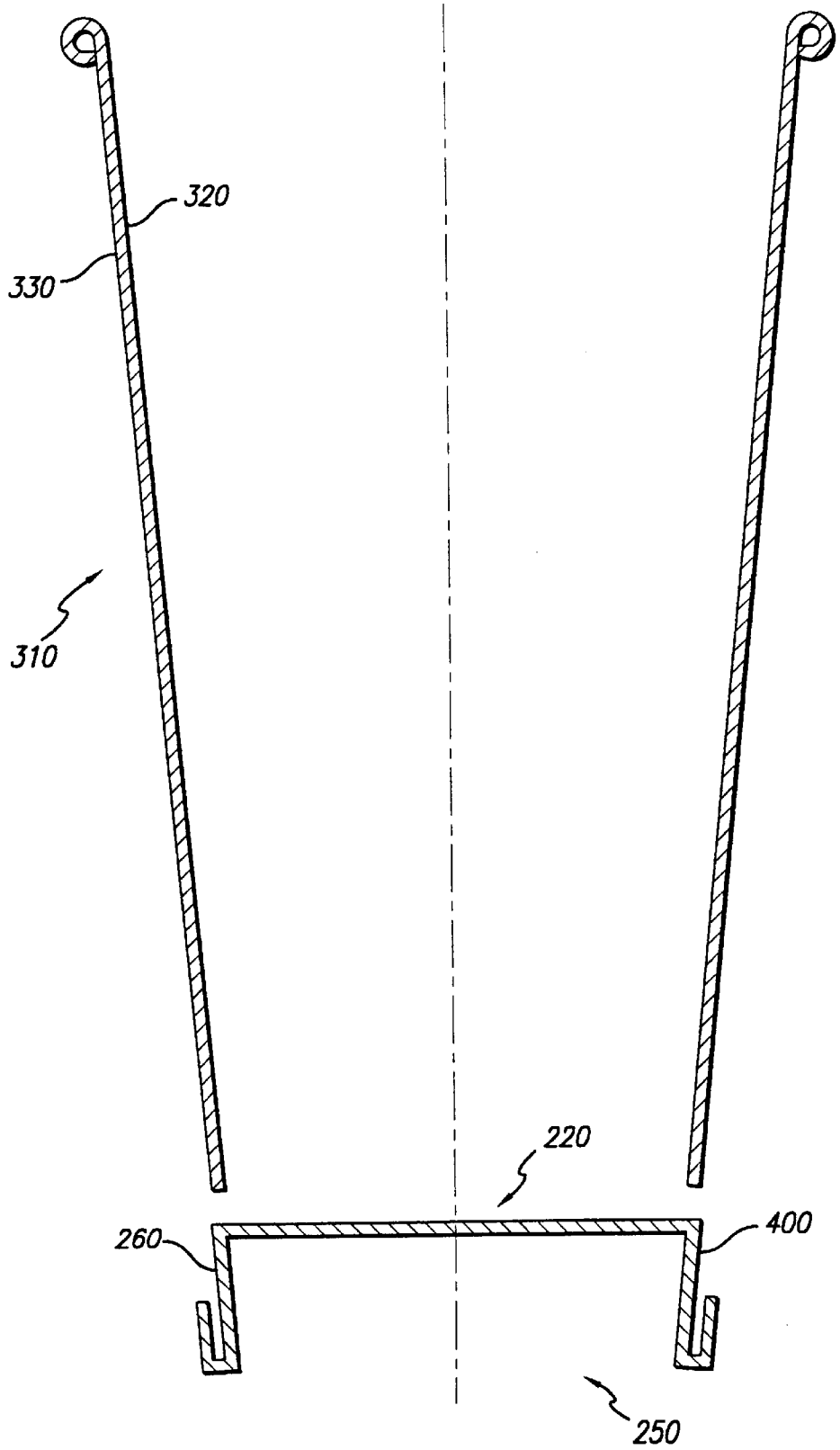
FIG. 4 is a schematic showing the placement of the polyethylene coatings.
Figure 8:
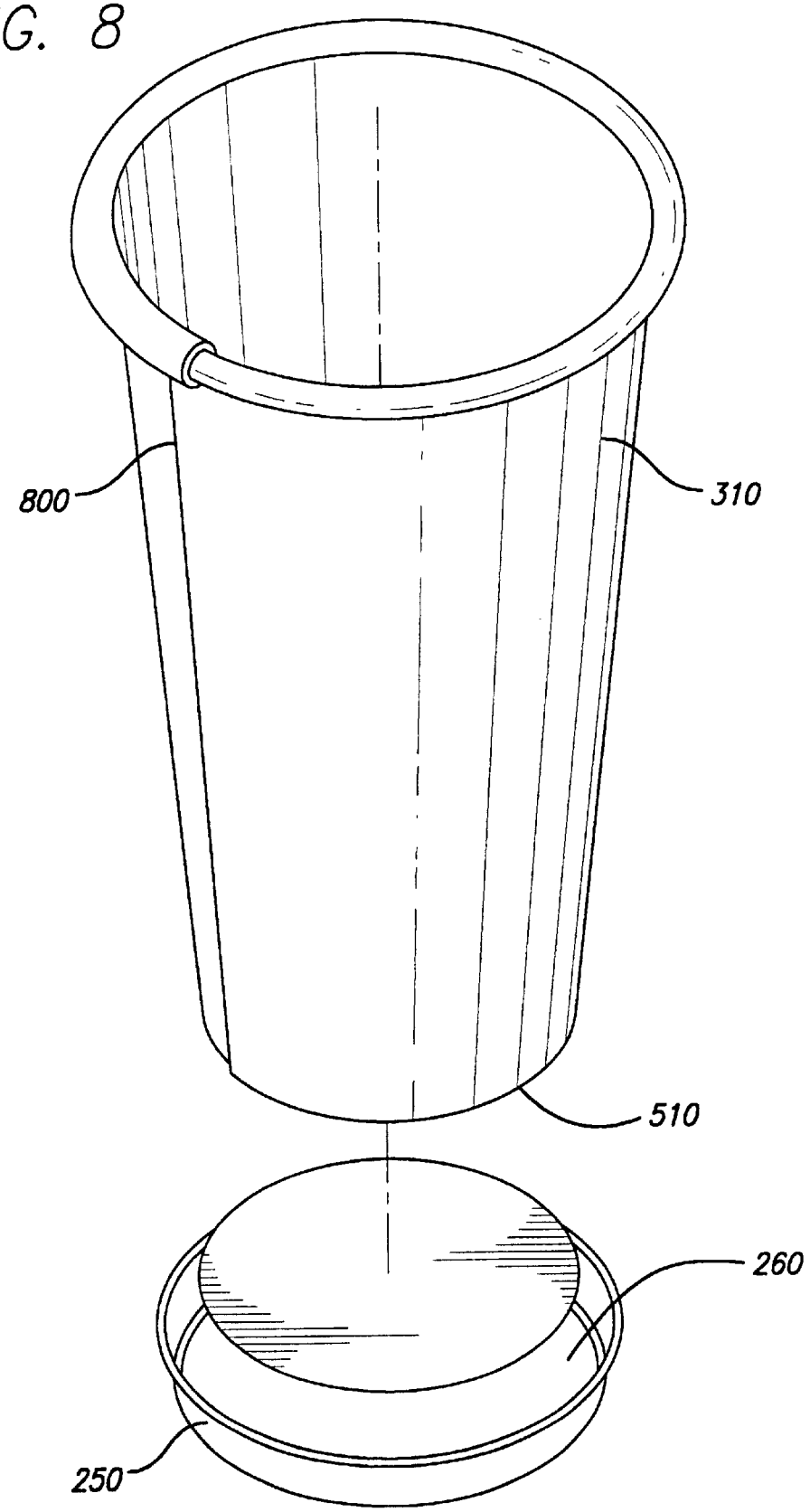
FIG. 8 is a perspective view showing how a top blank and a bottom blank are coupled in a u-shaped channel.
Figure 9:
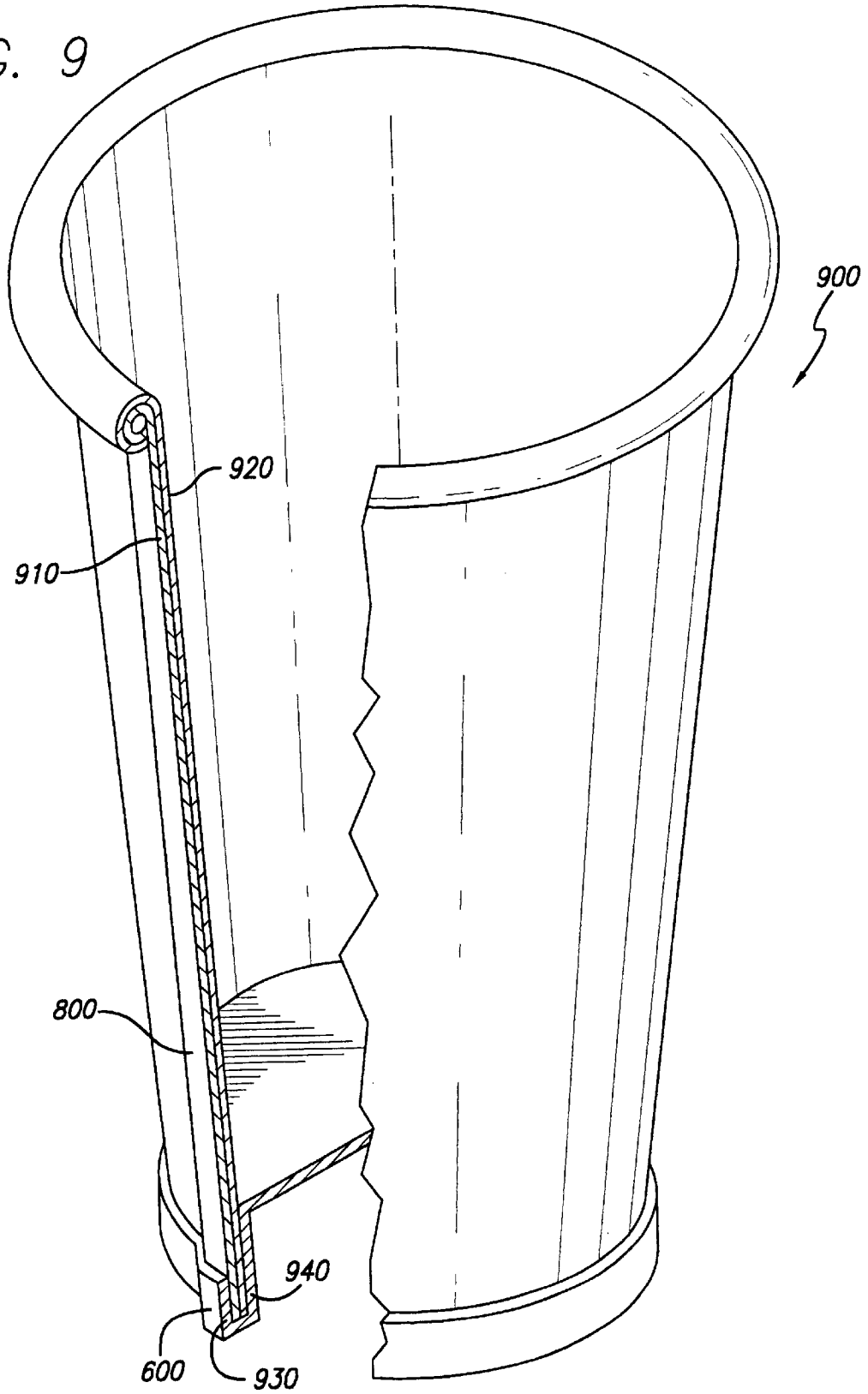
FIG. 9 is a cutaway perspective view of a side seam and X-point of a cup.

FIG. 4 shows the surfaces of the top and bottom blanks coated with polyethylene. When forming a foam-generated cup as disclosed in the following U.S. Pat. Nos. 5,766,709, 5,840,139, 5,993,705, 6,030,476, 6,129,653, 6,139,665, 6,142,331, 6,308,883, 6,319,590, and 6,328,557, the entire disclosures of which are incorporated herein by reference, the top blank 310 is coated on an inner surface 320 with polyethylene, preferably a blend of high density polyethylene (HDPE) and low density polyethylene (LDPE). The blend of HDPE and LDPE is used because it forms a better seal and bond under heat with the LDPE on an inside part 400 of the u-shaped channel 260 as well as with the outer surface 330 where side seam 800, as shown in FIGS. 8 and 9, is formed. When forming non-foam-generated cups the inner surface of the top blank is commonly coated with LDPE.

An upper surface 220 of the bottom blank 250 and an outer surface 330 of the top blank 310 are coated with polyethylene, preferably a low density polyethylene (LDPE). The coating is applied before any bending and therefore lines the u-shaped channel 260.

Figure 5:
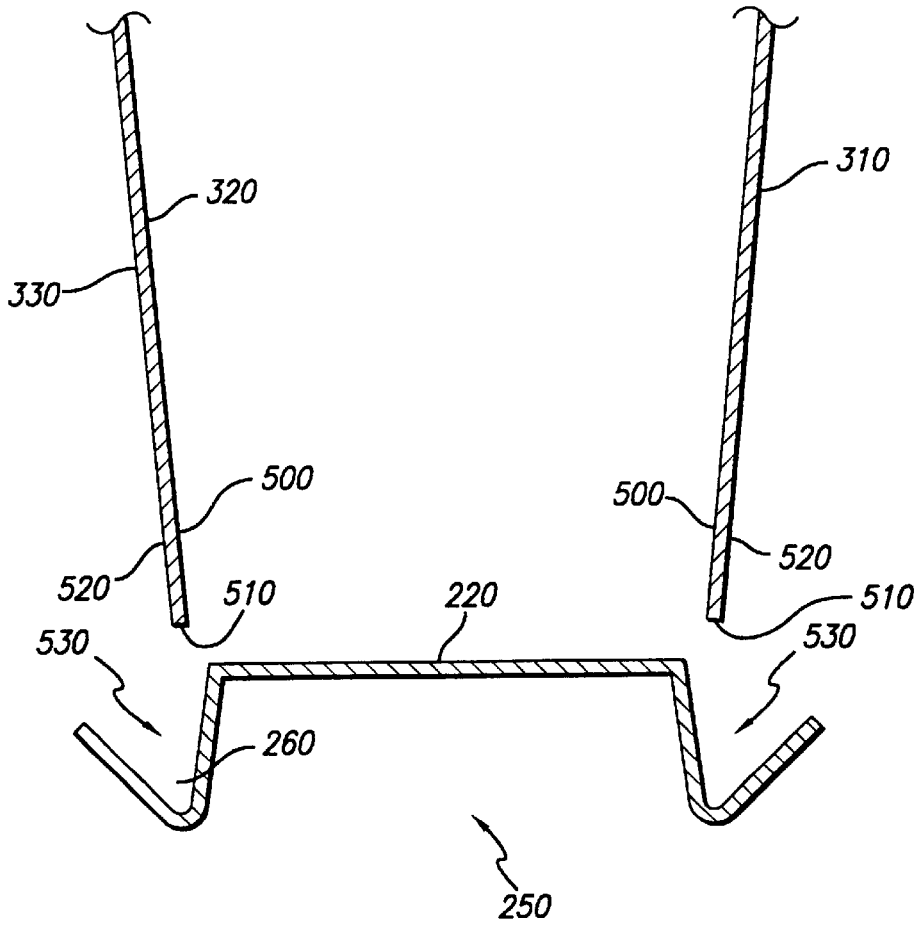
FIG. 5 is a cross sectional, elevational view showing where heat is applied to fuse the polyethylene coatings to their surfaces.
Figure 6:
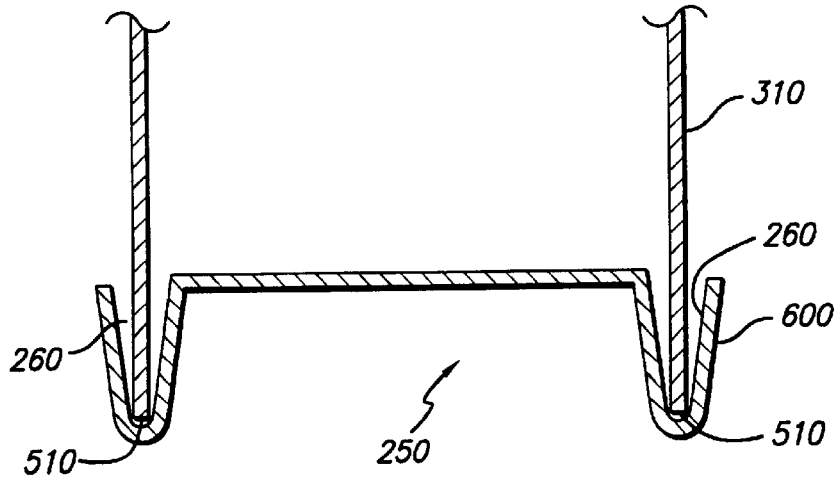
FIG. 6 is a cross sectional, elevational view of a top blank coupled to a bottom blank in a u-shaped channel.

FIGS. 5 and 6 show how the top blank 310 and the bottom blank 250 are joined together so a bottom edge 510 of the top blank 310 fits within the u-shaped channel 260 of the bottom blank 250. FIG. 5 further shows different methods of heat application prior to joining the top blank 310 to the bottom blank 250. Both methods fuse the polyethylene coating on the top blank 310 to the bottom blank 250. First, heat can be applied at 520, the outer 330 surface of the top blank 310, and at 500, the inner 320 surface of the top blank 310. Second, heat can be applied at 530, the inside of the u-shaped channel 260. FIG. 6 shows a bottom edge 510 of the top blank 310 fitting into the u-shaped channel 260 of the bottom blank 250 after either method of heat application.

Figure 7:
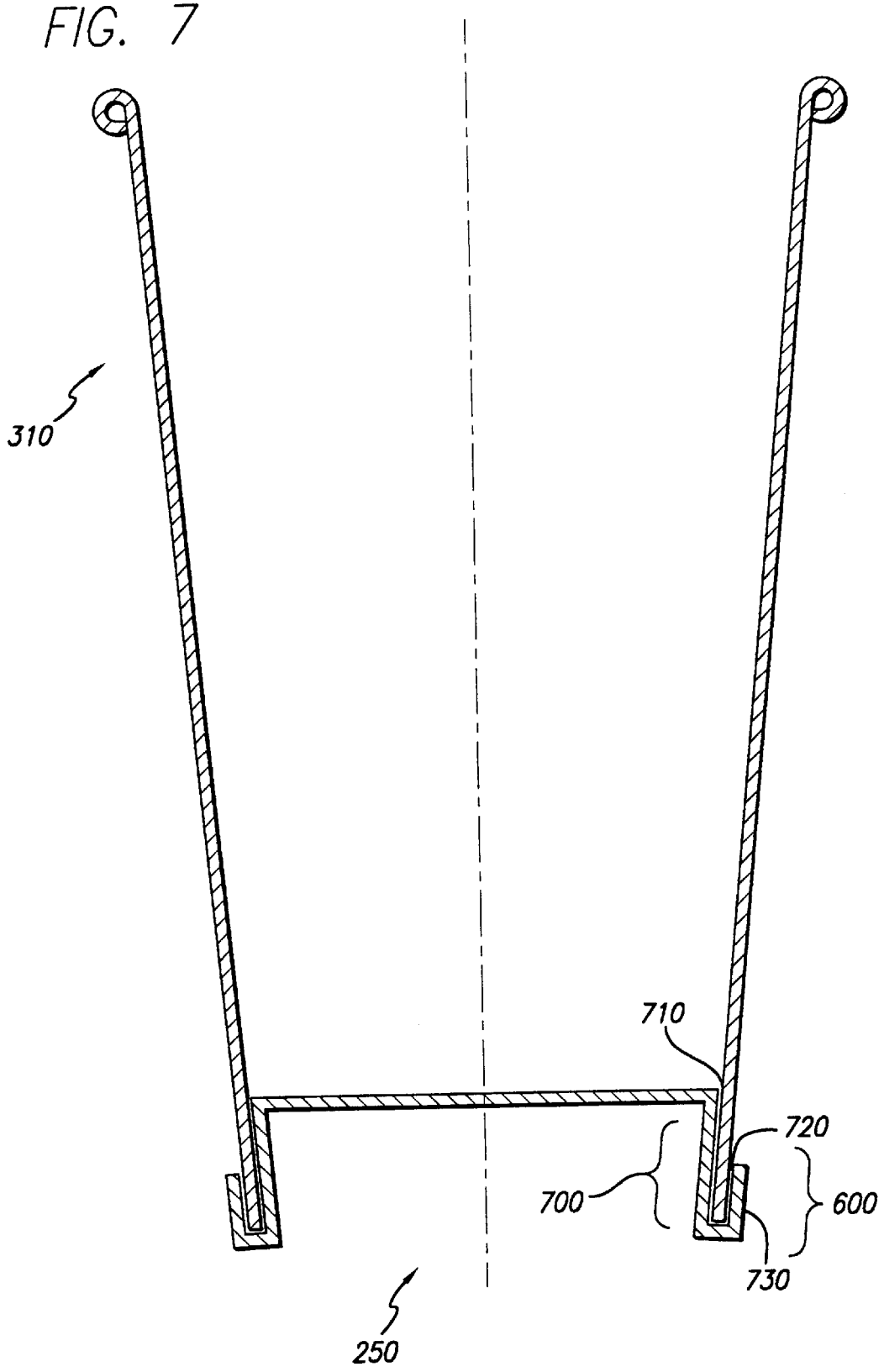
FIG. 7 is a cross sectional, elevation view showing where heat is applied to join a top blank and a bottom blank together.

FIG. 7 shows two more methods of heat application that occur after joining the top blank 310 to the bottom blank 250. First, heat can be applied at 730, an outer portion of the exterior of the u-shaped channel 260.

Second, heat can be applied at 700, an inner portion of the exterior of the u-shaped channel 260. To reach the first joining layer of polyethylenes 710, the heat at 700 need only penetrate one layer of board. However, to reach the second joining layer 720 of polyethylenes the heat at 700 needs to penetrate two layers of board. At the X-point 600, the heat at 700 needs to penetrate three layers of board to reach the second joining layer 720 of polyethylenes.

Both seals bond polyethylene to polyethylene creating a stronger bond.

FIG. 8 is an exploded perspective showing schematically how the top blank 310 lines up with the bottom blank 250 and how the bottom edge 510 of the top blank 310 fits into the u-shaped channel 260. FIG. 8 further shows a side seam 800 along the top blank 310.

Prior art cups are manufactured by forming a frustral conical top, wrapping a bottom blank around a lower outer portion of the top, and curling the edges of the bottom blank inwardly.

Figure 1A:
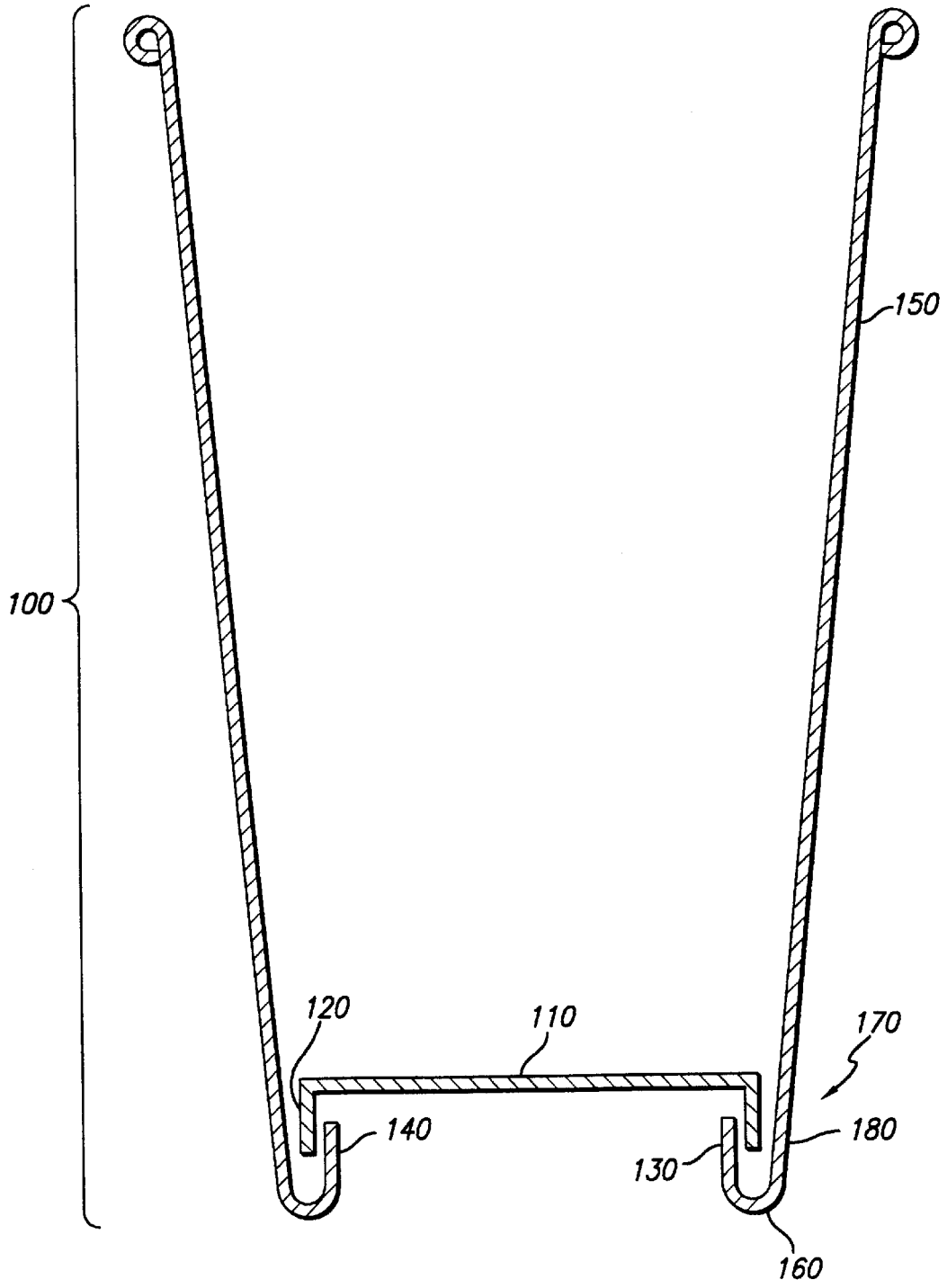
FIG. 1A PRIOR ART
FIG. 1A (Prior Art) is a cross sectional, elevational view of a conventional paper cup viewed at a side seam showing the X-point which is prone to leaking.

Unlike the prior art where a bottom edge of the top blank is folded inwardly and upwardly (See FIG. 1A), the present invention does not fold the bottom edge 510 of the top blank 310 (See FIG. 8). Therefore, there is one layer of board around the entire top blank 310 except at the side seam 800 where there are two layers of board joined to form the side seam 800.

An embodiment of the present invention is constructed by forming a bottom blank 250 into a frustral conical shape (See FIG. 2A), then wrapping a top blank 310 around the bottom blank 250 so that the bottom edge 510 of the top blank 310 fits into what will become the u-shaped channel 260 (See FIG. 5). Next, the outer edge of the bottom blank 250 is curled around the bottom edge 510 of the top blank 310 forming the u-shaped channel 260 (See FIG. 6).

FIG. 9 shows a cross-sectional cutaway of a completely formed cup 900 having a side seam 800 two layers thick. The X-point 600 is 4 layers thick.

The side seam's 800 two layers 910, 920 are shown within the u-shaped channel's two layers 930, 940 making the X-point 600 four layers thick. Having an X-point only four layers thick is a reduction by one layer of board over the prior art. This reduction in the number of board layers at the X-point aids in the final joining process and discloses a cup less likely to leak.

While certain exemplary embodiments have been described in detail it is to be understood that such embodiments are merely illustrative of and not restrictive on the broad invention, and that this invention is not to be limited to the specific arrangements and constructions shown and described, since various other modifications may occur to those with ordinary skill in the art.

What is claimed is:

1. A cup with an improved bottom seal for cups, the cup comprising:

a bottom portion having a u-shaped channel about a periphery of the bottom portion; and a top portion, wherein one edge of the top portion is coupled to the u-shaped channel.

2. The cup of claim 1, wherein an upper surface of the bottom portion is coated with polyethylene.

3. The cup of claim 1, wherein an inner surface of the top portion is coated with polyethylene.

4. The cup of claim 1, wherein an outer surface of the top portion is coated with polyethylene.

5. The cup of claim 2, wherein the upper surface of the bottom portion is coated with a low density polyethylene.

6. The cup of claim 3, wherein the inner surface of the top portion is coated with a blend of low density polyethylene and high density polyethylene.

7. The cup of claim 3, wherein the inner surface of the top portion is coated with low density polyethylene.

8. The cup of claim 4, wherein the outer surface of the top portion is coated with a low density polyethylene.

9. The cup of claim 1, wherein heat is applied to the top portion prior to coupling the top portion to the bottom portion.

10. The cup of claim 9, wherein the heat is applied to the inner surface of the top portion.

11. The cup of claim 9, wherein the heat is applied to the outer surface of the top portion.

12. The cup of claim 1, wherein heat is applied inside the u-shaped channel prior to coupling the top portion to the bottom portion.

13. The cup of claim 1, wherein heat is applied to an inner portion of an exterior of the u-shaped channel after coupling the top portion to the bottom portion.

14. The cup of claim 1, wherein heat is applied to an outer portion of an exterior of the u-shaped channel after coupling the top portion to the bottom portion.

15. The cup of claim 1, wherein an X-point has four layers.

16. The cup of claim 1, wherein the top portion is constructed from foamable material.

17. The cup of claim 1, wherein the bottom portion is constructed from foamable material.

18. The cup of claim 1, wherein the top portion is constructed from stock comprising a base layer, an insulating layer applied to at least one surface of the base layer and an expansion limiting layer applied to at least a portion of the insulating layer opposed to the base layer.

19. The cup of claim 1, wherein the bottom portion is constructed from stock comprising a base layer, an insulating layer applied to at least one surface of the base layer and an expansion limiting layer applied to at least a portion of the insulating layer opposed to the base layer.

20. The cup of claim 1, wherein an inner surface of the top portion is coated with a laminate synthetic resin.

21. The cup of claim 1, wherein an outer surface of the top portion is coated with a foamable synthetic resin.

22. The cup of claim 1, wherein a surface of the top portion is coated with a thermoplastic synthetic resin.

23. The cup of claim 1, wherein a surface of the bottom portion is coated with a thermoplastic synthetic resin.

24. The cup of claim 22 or 23, wherein heat is applied to the coated surface.

* * * * *